United States Patent [19]

Horodysky

[11] Patent Number: 4,788,340

[45] Date of Patent: Nov. 29, 1988

[54] BORATED HYDROXYL-CONTAINING COMPOSITIONS AND LUBRICANTS CONTAINING SAME

[75] Inventor: Andrew G. Horodysky, Cherry Hill, N.J.

[73] Assignee: Mobil Oil Corporation, New York, N.Y.

[21] Appl. No.: 68,379

[22] Filed: Jul. 1, 1987

Related U.S. Application Data

[63] Continuation-in-part of Ser. No. 862,155, May 12, 1986, Pat. No. 4,692,257, which is a continuation of Ser. No. 753,098, Jul. 9, 1985, abandoned, which is a continuation of Ser. No. 304,482, Sep. 22, 1981, abandoned.

[51] Int. Cl.[4] ..... C10M 141/02

[52] U.S. Cl. ..... 568/1; 252/49.6; 252/389.41; 252/400.41; 44/76

[58] Field of Search ..... 252/49.6, 389.41, 400.41; 44/76; 568/1

[56] References Cited

U.S. PATENT DOCUMENTS

| | | | |
|---|---|---|---|
| 2,795,548 | 6/1957 | Thomas et al. | 252/49.6 |
| 2,975,135 | 3/1961 | Darling et al. | 252/49.6 |
| 2,979,459 | 4/1961 | Darling et al. | 252/49.6 |
| 3,400,083 | 9/1968 | Schuzar et al. | 252/42.7 |
| 4,406,803 | 9/1983 | Liston et al. | 252/52 |
| 4,563,293 | 1/1986 | Small, Jr. | 252/32.7 |
| 4,629,576 | 12/1986 | Small, Jr. | 252/32.7 |

*Primary Examiner*—Jacqueline V. Howard
*Attorney, Agent, or Firm*—Alexander J. McKillop; Michael G. Gilman; Van D. Harrison, Jr.

[57] ABSTRACT

Disclosed are multifunctional additives for fuel and lubricant compositions. These additives are borated hydrocarbyl vicinal diols, made by reacting the diol with a boron-containing compound such as boric acid or trialkyl borate. These are useful in formulating lubricants and liquid hydrocarbon fuels.

5 Claims, No Drawings

BORATED HYDROXYL-CONTAINING COMPOSITIONS AND LUBRICANTS CONTAINING SAME

RELATED APPLICATIONS

This is a continuation-in-part of application Ser. No. 862,155, filed May 12, 1986, now U.S. Pat. No. 4,692,257 which is a continuation of Ser. No. 753,098, filed July 9, 1985, now abandoned, which is a continuation of Ser. No. 304,482, filed Sept. 22, 1981, now abandoned.

BACKGROUND OF THE INVENTION

1. FIELD OF THE INVENTION

The invention relates to lubricant and liquid fuel compositions. In particular, it relates to the use of borated derivatives of hydrocarbyl vicinal diols in liquid fuels and lubricants to reduce friction and fuel consumption in internal combustion engines. In another aspect this invention relates to the borated derivatives of hydrocarbyl vicinal diols.

2. DISCUSSION OF THE PRIOR ART

Alcohols are well known for their lubricity properties when formulated in lubricated oils and for their water-scavenging characteristics when blended into fuels. The use of vicinal hydroxyl-containing alkyl carboxylates such as glycerol monooleate have also found widespread use as lubricity additives. U.S. Pat. No. 2,788,326 discloses some of the esters suitable for the present invention, e.g. glycerol monooleate, as minor components of lubricating oil compositions. U.S. Pat. No. 3,235,498 discloses, among others, the same ester as just mentioned, as an additive to other oils. U.S. Pat. No. 2,443,578 teaches esters wherein the free hydroxyl is found in the acid portion, as for example in tartaric acid.

The above patents, as are numerous others, are directed to the use of such esters as additives. Other patents, such as U.S. Pat. Nos. 2,798,083; 2,820,014; 3,115,519; 3,282,971; and 3,309,318 as well as an article by R. R. Barnes et al. entitled "Synthetic Ester Lubricants" in Lubrication Engineering, August, 1975, pp. 454–457, teach lubricants prepared from polyhydric alcohols and acid containing no hydroxyl other than those associated with the acid function.

So far as is known, no effort has been made to employ borated hydrocarbyl vicinal diols as a fuel or lubricant additive. It is known that borated hydrocarbyl and borated aliphatic diols are known for other uses. For example, U.S. Pat. No. 3,740,358 teaches a phenol-aldehyde foamable composition containing a boron compound, e.g. a material formed by reacting boric acid or boric oxide with such aliphatic hydroxyl-containing compound.

SUMMARY OF THE INVENTION

In accordance with the present invention there is provided a liquid fuel or lubricant composition comprising fuel or lubricant and a borated hydrocarbyl vicinal diol containing 10 to 30 carbon atoms. In such lubricant compositions, the product can be used in friction-reducing amount, which can range from about 0.1% by weight to about 10% by weight. The borated products also have significantly greater friction-reducing properties, higher viscosity indices and good low temperature characteristics and solubility characteristics when used in low additive concentrations. As used herein, "hydrocarbyl" includes, but is not limited to decyl, dodecyl, tetradecyl, pentadecyl, hexadecyl, octadecyl, eicosyl and the like.

BACKGROUND OF THE INVENTION

It has now been found that boration of these long-chain alkyl terminal vicinal diols significantly improves friction-reducing properties and imparts an anti-oxidant component to these novel compositions. In addition to the friction-reducing properties described, the alkyl terminal vicinal diol borate esters possess much improved solubility characteristics, especially in synthetic fluids, over those of the non-borated derivatives. These borates are non-corrosive to copper, possess anti-oxidant and potential anti-fatigue characteristics.

The hydrocarbyl vicinal diols contemplated for use in this invention are hydrocarbyl diols having vicinal hydroxyls. They have the formula:

$$R(-OH)_2$$

wherein R is a hydrocarbyl group containing 10 to 30 carbon atoms. R can be linear or branched, saturated or unsaturated with linear saturated members being preferred to maximize friction reduction. The two hydroxyl groups can be anywhere along the hydrocarbyl chain as long as they are on adjacent carbon atoms (vicinal), but the terminal diols are much preferred.

The vicinal diols can be synthesized using several methods known to the art such as that described in *J. Am. Chem. Soc.*, 68, 1504 (1946) which involves the hydroxylation of l-olefins with peracids. Vicinal diols can also be prepared by the peroxytrifluoroacetic acid method for the hydroxylation of olefins as described in *J. Am. Chem. Soc.*, 76, 3472 (1954). Similar procedures can be found in U.S. Pat. Nos. 2,411,762, 2,457,329, 2,455,892.

The diols can also be prepared via catalytic epoxidation of an appropriate olefin followed by hydrolysis to form the appropriate vicinal diol.

The preferred borated vicinal diols contain 12 to 20 carbon atoms. Below a carbon number of 12 friction-reducing properties as significantly reduced. Above a carbon number of 20, solubility constraints become significant. Preferred are the $C_{14}$–$C_{17}$ hydrocarbyl groups in which solubility, frictional characteristics and other properties are maximized.

Among the diols contemplated for reaction with the boron compound are 1,2-hexanediol, 1,2-decanediol, 1,2-dodecanediol, 1,2-tetradecanediol, 1,2-pentadecanediol, 1,2-octadecanediol, 1,2-mixed $C_{15}$–$C_{18}$-alkane diols and mixtures thereof.

The boronated compound used in this invention can be made using a single diol or two or more diols. A mixture of diols can contain from about 5% to about 95% by weight of any one diol, the other diol or diols being selected such that it or they together comprise from about 95% to about 5% by weight of the mixture. Such mixtures are often preferred to the single diol.

Reaction with the boron compound of the formula $$(RO)_xB(OH)_y$$

where

R is a $C_1$ to $C_6$ alkyl, x is 0 to 3 and y is 0 to 3, the sum of x and y being 3, can be performed in the presence of an alcoholic solvent, such as butanol or pentanol, or a hydrocarbon solvent such as benzene, toluene or xylene, or mixtures of such solvents. Reaction temperatures of 90° C. to 260° C. or more can be used, but 110° to 200° C. is preferred. Reaction times can be 1 to 24 hours and more. Up to a stoichiometric amount of boric acid can be used, or an excess thereof can be used to produce a derivative containing from about 0.1% to about 10% of boron. At least 5 to 10% of the available hydroxyl groups of the diol should be borated to derive substantial beneficial effect. Conversely, a stoichiometric excess of boric acid (more than an equivalent amount of boronating agent compared to diol hydroxyl groups) can also be charged to the reaction medium resulting in a product containing the stated amount of boron. The boronated diols can also be borated with a trialkyl borate such as tributyl borate, often in the presence of boric acid. Those reaction products are preferred, however, which contain a molar excess (greater than 1:1) of diol over borating agent (e.g. boric acid). Such reaction products are believed to be more hydrolysis stable because of the additional diol present. Hydrolysis could result in plating out boric acid on engine parts under high concentrations of moisture. Preferred reaction temperatures for boration with the borate will range from about 180° C. to about 280° C. Times can be from about 2 to about 12 hours, or more.

As disclosed hereinabove, the borated esters are used with lubricating oils to the extent of from about 0.1% to about 10% by weight of the total composition. Furthermore, other additives, such as detergents, anti-oxidants, anti-wear agents and the like may be present. These can include phenates, sulfonates, succinimides, zinc dithiophosphates, polymers, calcium and magnesium salts and the like.

The lubricants contemplated for use with the esters herein diclosed include mineral and synthetic hydrocarbon oils of lubricating viscosity mixtures of mineral oils and synthetic oils and greases from any of these, including mixtures. The synthetic hydrocarbon oils include long-chain alkanes such as cetanes and olefin polymers such as oligomers of hexane, octene, decene, and dodecene, etc. These vicinal diols are especially effective in synthetic oils formulated using mixtures of synthetic hydrocarbon olefin oligomers and lesser amounts of hydrocarbyl carboxylate ester fluids. The other synthetic oils, which can be used alone with the borated compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic mono- carboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate- acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydro- phobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite. attapulgite, hectorite, illite, saponite, sepiolite, biotite, vermiculite, zeolite clays, and the like. The thickening agent is employed in an amount from about 0.5 to about 30, and preferably from 3 percent to 15, percent by weight of the total grease composition.

The liquid fuels contemplated include liquid hydrocarbon fuels such as fuel oils, diesel oils and gasolines and alcohol fuels such as methanol and ethanol or mixtures of these fuels.

In all reactions described hereinabove, a solvent is preferred. Solvents that can be used include the hydrocarbon solvents, such as toluene, benzene, xylene, and the like, alcohol solvents such as propanol, butanol, pentanol and the like, as well as mixtures of hydrocarbon solvents or alcohol solvents and mixtures of hydrocarbon and alcohol solvents.

Having described the invention in general terms, the following are offered to specifically illustrate the development. It is to be understood they are illustrations only and that the invention shall not be limited except as limited by the appended claims.

EXAMPLE 1

1,2-Hexadecanediol Borate

Approximately 86 g of 1,2-hexadecanediol and approximatel 200 g toluene solvent was charged to a 1 liter reactor equipped with agitator, heater and Dean-Stark tube with condenser. The contents were heated up to 80°-90° C. to dissolve the diol and approximately 11 g boric acid was added. The mixture was heated up to 155° C. until water evolution stopped over a period of 4 hours. Approximately 9 ml water was removed by azeotropic distillation. The solvent was removed by vacuum distillation and the product was filtered at 100° C. through diatomaceous earth. The product became waxy after cooling.

EXAMPLE 2

1,2-Dodecanediol Borate (High Boron Content)

Approximately 151 g of 1,2-dodecanediol and 150 g of toluene were charged to a 1 liter reactor equipped with agitator, heater and Dean-Stark tube with condenser and provision for using a nitrogen vapor space blanket. The contents were heated up to 75° C., and 45 g of boric acid was added. The mixture was heated up to 155° C. over a period of 5 hours until water evolution stopped. The solvent was removed by vacuum distillation and the product was filtered hot through diatomaceous earth. The product was a viscous, clear yellow fluid.

EXAMPLE 3

1,2-Dodecandiol

Approximately 303 g of 1,2-dodecanediol and 250 g of toluene were charged to a 1 liter reactor equipped as described in Example 2. The contents were heated up to 70° C. and 62 g of boric acid was added. The mixture was heated up to 160° C. over a period of 6 hours until water evolution stopped. The solvent was removed by vacuum distillation and the product was filtered hot through diatomaceous earth.

EXAMPLE 4

1,2-Mixed $C_{15}$–$C_{18}$ Alkanediol Borate (High Boron Content)

Approximately 155 g of 1,2-mixed $C_{15}$–$C_{18}$ alkanediols and 130 g of toluene were charged to a 1 liter reactor equipped as described in Example 2. The contents were heated up to 65° C. and 34 g of boric acid was added. The mixture was heated up to 160° C. over a period of 4½ hours until water evolution stopped. The solvent was removed by vacuum distillation and the product was filtered hot through diatomaceous earth, yielding a white waxy solid after cooling.

EXAMPLE 5

1,2-Mixed $C_{15}$–$C_{18}$ Alkanediol Borate

Approximately 265 g of 1,2-mixed $C_{15}$–$C_{18}$ alkanediols and 200 g of toluene were charged to a 1 liter reactor equipped as described in Example 2. The contents were heated to 70° C. and 42 g of boric acid was added. The mixture was heated up to 155° C. over a period of 5 hours until water evolution stopped. The solvent was removed by vacuum distillation and the product was filtered at 100° C. through diatomaceous earth.

The product of the Examples were blended into a fully formulated 5W-20 synthetic automotive engine oil containing other additives, such as detergent, dispersant, anti-oxidant and the like additives and evaluated using the Low Velocity Friction Apparatus (LVFA) test.

EVALUATION OF PRODUCTS

The compound were evaluated as friction modifiers in accordance with the following test.

LOW VELOCITY FRICTION APPARATUS

Description

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12–13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The friction-reducing ester additives were evaluated in a fully formulated 5W-20 synthetic lubricating oil comprising an additive package including anti-oxidant, detergent and dispersant. The oil had the following general characteristics:

Viscosity 100° C.: 6.8 cs
Viscosity 40° C.: 36.9 cs
Viscosity Index: 143

TABLE 1

| Friction Test Results Using Low Velocity Friction Apparatus | | | | |
|---|---|---|---|---|
| | | Additive Conc. in | % Reduction in Coefficient of Friction in LVFA at | |
| Example | Additive | Base Blend | 5 Ft./Min. | 30 Ft./Min. |
| Base Blend | Fully formulated engine oil | — | 0 | 0 |
| 1 | Borated 1,2-hexadecanediol | 1 | 45 | 30 |
| | | 0.5 | 41 | 32 |
| | | 0.25 | 28 | 28 |
| 2 | Borated 1,2-dodecanediol (high boron content) | 2 | 33 | 22 |
| | | 1 | 45 | 35 |
| | | 0.5 | 34 | 27 |
| 3 | Borated 1,2-dodecanediol | 1 | 37 | 27 |
| | | 0.5 | 37 | 31 |
| 4 | Borated 1,2-mixed $C_{15}$–$C_{18}$ alkanediols (high boron content) | 2 | 42 | 35 |
| | | 0.5 | 33 | 27 |
| 5 | Borated 1,2-mixed $C_{15}$–$C_{18}$ alkanediols | 1 | 42 | 31 |
| | | 0.5 | 40 | 28 |

The results clearly show the borated hydrocarbyl vicinal diol to be a far superior friction reducer. For example, the use of only ½% of Example 5, borated 1,2-mixed $C_{15}$–$C_{18}$ alkanediols reduces the coefficient of friction by 40%/28%. The products of this invention were tested in a catalytic oxidation test for lubricants, using as the base oil a 200" solvent paraffinic neutral mineral oil. The test lubricant composition is subject to a stream of air bubbled through the composition at a rate of 5 liters per hour at 325° F. for 40 hours. Present in the composition are metals commonly used as materials of engine construction, namely:

a. 15.6 sq. in. of sand-blasted iron wire,
b. 0.78 sq. in. of polished copper wire,
c. 0.87 sq. in. of polished aluminum wire, and
d. 0.167 sq. in. of polished lead surface.

Inhibitors for oil are rated on the basis of prevention of oil deterioration as measured by the increase in acid formation or neutralization number (NN) and kinematic viscosity (KV) occasioned by the oxidation. The results of the tests are reported in Table 2.

TABLE 2

| Catalytic Oxidation Test 40 Hours @ 325° F. | | | |
|---|---|---|---|
| Additive | Additive Conc. Wt. % | % Increase in Viscosity, KV at 100° C. | Neutralization Number |
| Base Oil Only | — | 67 | 3.62 |
| Example 1 | 1 | 22 | 1.96 |
| | 3 | 38 | 1.60 |
| Example 2 | 0.25 | 18 | 1.95 |
| | 0.5 | 19 | 1.71 |
| | 1 | 15 | 1.32 |
| | 3 | 4 | 0.55 |
| Example 3 | | | |
| Example 4 | 1 | 11 | 2.10 |

TABLE 2-continued

| Catalytic Oxidation Test 40 Hours @ 325° F. | | | |
|---|---|---|---|
| Additive | Additive Conc. Wt. % | % Increase in Viscosity, KV at 100° C. | Neutralization Number |
| | 3 | 15 | 1.89 |
| Example 5 | 1 | 13 | 2.43 |
| | 3 | 17 | 2.84 |

The results clearly show the effectiveness of the borates at controlling viscosity increase and neutralization number increase under somewhat severe oxidation conditions.

What is claimed is:

1. The reaction product resulting from the reaction of a 1,2-hydrocarbyl vicinal diol having the formula:

$$R(—OH)_2$$

wherein R is a hydrocarbyl group containing about 10 to about 30 carbon atoms with a boron compound of the formula $$(R_1O)_xB(OH)_y$$

where $R_1$ is a $C_1$ to $C_6$ alkyl group, x is 0 to 3, and y is 0 to 3, the sum of x and y being 3.

2. The reaction product of claim 1 wherein said hydrocarbyl is selected from the group consisting of decyl, dodecyl, tetradecyl, pentadecyl, hexadecyl, octadecyl, or eicosyl.

3. The reaction product of claim 1 wherein said boron compound is boric acid.

4. The reaction product of claim 1 wherein the ratio of reactants is about 1.5 to about 1.8 moles of 1,2-hydrocarbyl vicinal diol to about 1 mole of borating agent.

5. The reaction product of claim 1 wherein the ratio of reactants is about 1.5 moles of 1,2-hydrocarbyl vicinal diol to about 1 mole of borating agent.

* * * * *